US008840532B2

(12) United States Patent
Hetrick et al.

(10) Patent No.: US 8,840,532 B2
(45) Date of Patent: Sep. 23, 2014

(54) STRAP ADJUSTER AND KEEPER AND METHOD OF STRAP CONTROL

(75) Inventors: Randal Hetrick, San Francisco, CA (US); Jordan Edward Macdonald, Palo Alto, CA (US); Stephanie Russo, San Francisco, CA (US)

(73) Assignee: Fitness Anywhere, LLC, San Francisco, CA (US)

( * ) Notice: Subject to any disclaimer, the term of this patent is extended or adjusted under 35 U.S.C. 154(b) by 299 days.

(21) Appl. No.: 13/194,522

(22) Filed: Jul. 29, 2011

(65) Prior Publication Data

US 2013/0029813 A1 Jan. 31, 2013

(51) Int. Cl.

| | |
|---|---|
| ***A63B 71/00*** | (2006.01) |
| ***A44B 11/25*** | (2006.01) |
| ***A63B 21/16*** | (2006.01) |
| ***A63B 21/00*** | (2006.01) |
| ***A63B 21/068*** | (2006.01) |

(52) U.S. Cl.

CPC ..... *A63B 21/068* (2013.01); *A63B 2225/09* (2013.01); *A44B 11/2557* (2013.01); *A63B 21/1636* (2013.01); *A63B 21/1484* (2013.01); *A63B 21/1469* (2013.01)

USPC ..... 482/139; 482/126; 482/143

(58) Field of Classification Search

USPC ..... 482/43, 91–96, 139, 120, 121, 129, 482/143, 908, 907, 142; 24/31 R, 32, 33 L, 24/31 F, 68 R, 69 ST, 163 R, 164; 2/319, 2/321, 322, 323, 325, 338, 342

See application file for complete search history.

(56) References Cited

U.S. PATENT DOCUMENTS

| | | | | |
|---|---|---|---|---|
| 186,128 | A * | 1/1877 | Guerrero | 24/32 |
| 2,269,696 | A * | 1/1942 | Shaulson | 24/200 |
| 3,063,718 | A * | 11/1962 | Steinkamp | 473/502 |
| 3,222,687 | A * | 12/1965 | Rosenzweig | 2/323 |
| 5,205,021 | A * | 4/1993 | Durand | 24/163 R |
| 5,518,486 | A * | 5/1996 | Sheeler | 482/131 |
| 6,726,606 | B2 | 4/2004 | Jacobsen | |
| 2006/0264302 | A1 | 11/2006 | Sjodin | |
| 2007/0066450 | A1 | 3/2007 | Hetrick | |
| 2007/0173383 | A1 | 7/2007 | Feigenbaum et al. | |
| 2007/0275796 | A1 * | 11/2007 | Carter | 473/459 |
| 2009/0075788 | A1 * | 3/2009 | Hetrick | 482/91 |

OTHER PUBLICATIONS international Search Report and Written Opinion PCT/US2012/048525, Jan. 30, 2010.

* cited by examiner

*Primary Examiner* — Loan H Thanh
*Assistant Examiner* — Nyca T Nguyen
(74) *Attorney, Agent, or Firm* — Vedder Price PC

(57) ABSTRACT

A method of strap control and an apparatus including a combined strap-length adjuster and strap keeper is disclosed for use with strap-length adjuster comprising two rings. The strap-length adjuster includes openings that permit the attachment of a tether to the strap keeper. The arrangement allows the tether to not interfere with the positioning or movement of the straps, and maintains the straps close to the strap-length adjuster and prevents slippage of the strap through the strap-length adjuster.

19 Claims, 8 Drawing Sheets

STRAP ADJUSTER AND KEEPER AND METHOD OF STRAP CONTROL

BACKGROUND OF THE INVENTION

1. Field of the Invention

The present invention generally relates to an apparatus and method for adjusting the length of a strap, and more particularly to an apparatus and method for strap control with a strap-length adjuster comprising two rings.

2. Discussion of the Background

Mechanisms for adjusting the length of a strap, referred to herein as strap-length adjusters, are commonly used in belts, for tying down objects, and in adjustable exercise devices. Strap-length adjusters typically provide a gripping force on a strap at fixed positions (as in belt buckles) or at a variable positions (using clamping devices). In both cases the loose strap end protrudes away from the strap-length adjuster. In many instances it is desirable to keep loose ends from moving by keeping them near the strap. Such devices are referred to as strap keepers. For some mechanisms, the movement of an end of the gripped strap may loosen the mechanism, rendering the mechanism ineffective.

There is a need in the art for a method of combining a strap-length adjuster and a strap keeper. There is also a need in the art for an apparatus that includes a strap-length adjuster that includes a strap keeper. Such an apparatus and method should be easy to use and should automatically keep the strap close to strap-length adjuster.

BRIEF SUMMARY OF THE INVENTION

The present invention overcomes the disadvantages of prior art by combining a tethered strap keeper with a strap-length adjuster.

Certain embodiments provide an apparatus for attaching to a closed loop of a first strap and for providing a gripping force to a second strap having a free end. The apparatus includes a strap keeper to accept the second strap; a strap-length adjuster including a first element having a first opening and a second element having a second opening each sized for jointly accepting the closed loop, where the second element includes a third opening and a crossbar disposed between the first opening and the third opening; and a tether attached to the strap keeper, where the tether is attached to the crossbar. The free end can be wrapped through the first opening and the third opening to adjust the position of the second strap in the strap-length adjuster; the strap keeper can accept the second strap and the free end of the second strap; and the movement of the strap keeper is limited by the tether.

Certain other embodiments provide an exercise device including: an inelastic strap; a pair of grips attached to said strap; and at least one apparatus attached to said strap, such that the length of said strap between said grips is adjust-able. The apparatus includes a strap keeper to accept the second strap; a strap-length adjuster including a first element having a first opening and a second element having a second opening each sized for jointly accepting the closed loop, where the second element includes a third opening and a crossbar disposed between the first opening and the third opening; and a tether attached to the strap keeper, where the tether is attached to the crossbar. The free end can be wrapped through the first opening and the third opening to adjust the position of the second strap in the strap-length adjuster; the strap keeper can accept the second strap and the free end of the second strap; and the movement of the strap keeper is limited by the tether.

Yet certain other embodiments provide a method of providing strap control using a strap keeper and a strap-length adjuster attachable to a closed loop of a first strap and adapted to accept a free end of a second strap. The strap-length adjuster includes a first element having a first opening and a second element having a second opening each sized for jointly accepting the closed loop, where the second element includes a third opening and a crossbar disposed between the first opening and the third opening, such that the free end can be wrapped through the first opening and the third opening to adjust the position of the second strap in the strap-length adjuster, such that the strap keeper can accept the second strap and the free end of the second strap. The method includes attaching a tether to the strap keeper and to the crossbar, such that the movement of the strap keeper is limited by the tether.

These features together with the various ancillary provisions and features which will become apparent to those skilled in the art from the following detailed description, are attained by the combined strap-length adjuster and strap keeper of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

Disclosed herein is an apparatus and method for adjusting the length of a strap including a strap-length adjuster and a strap keeper, or in short, a strap adjuster and keeper. Embodiments of strap adjuster and keeper 100 are shown as a strap adjuster and keeper 100*a* and 100*b* as utilized in an exercise device 10. Exercise device 10 is shown for illustrative purposes only, and is not meant to limit the scope of the present invention, except as explicitly claimed.

Exercise device 10, for example, includes a door mount 20, a first inelastic strap 11 having a first free end 13*a* and a second free end 13*b*, and second and third inelastic straps 15*a* and 15*b* terminating in grips 17*a* and 17*b*, respectively. First strap adjuster and keeper 100*a* and second strap adjuster and keeper 100*b* accept free ends 13*a* and 13*b*, respectively, and permit adjustment of the supporting length of first strap 11 by pulling on one or more of first free end 13*a* and second free end 13*b*, as discussed subsequently. First strap adjuster and keeper 100*a* and second strap adjuster and keeper 100*b* also support second strap 15*a* and third strap 15*b*, respectively. Examples of exercise device 10 may be found, for example and without limitation, in co-owned U.S. Pat. Nos. 7,044,896 and 7,762,932, the contents of which are incorporated herein by reference.

Figure 1:
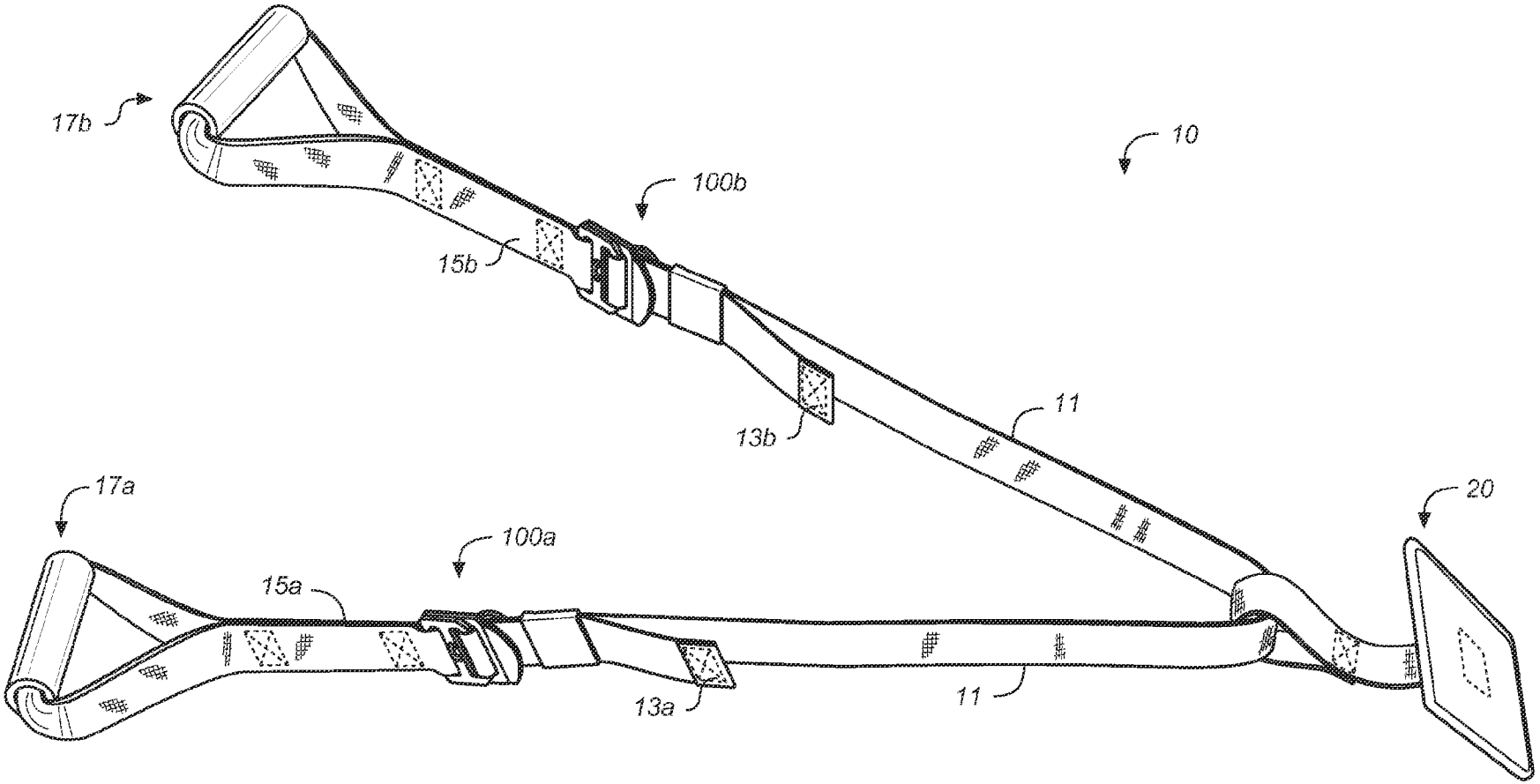
FIG. 1 is a perspective view of one embodiment of a strap adjuster and keeper.
Figure 2:
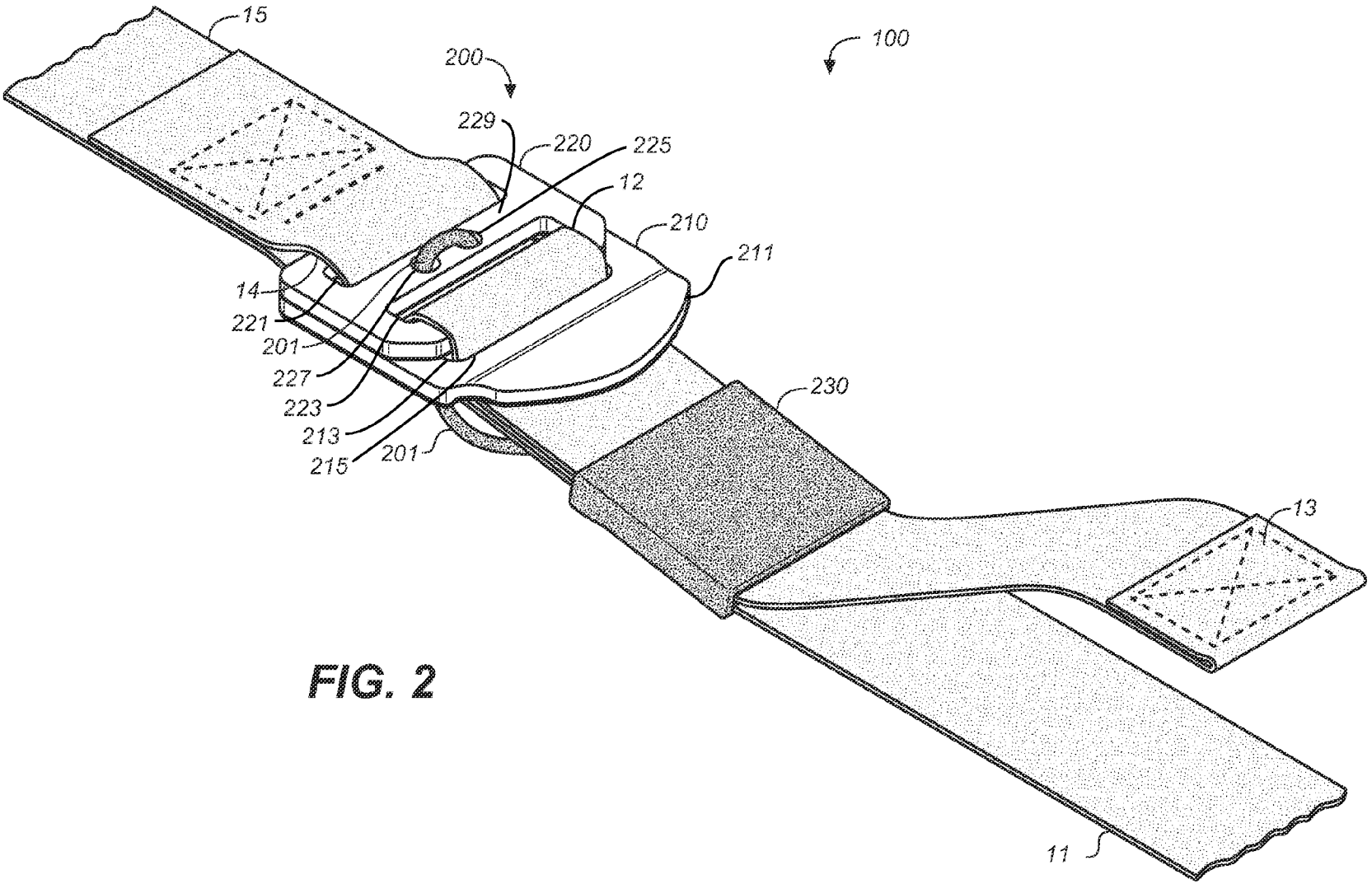
FIG. 2 is a detailed perspective view of another embodiment of the strap adjuster and keeper.
Figure 3A:
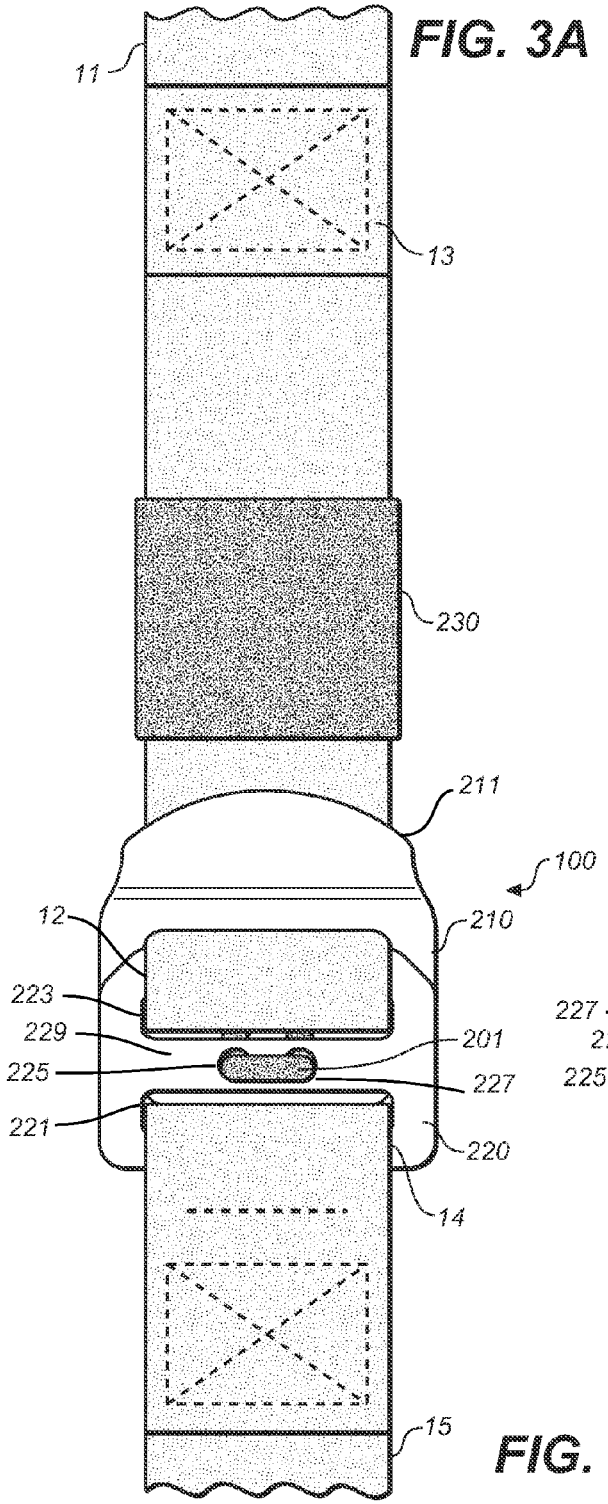
FIGS. 3A and 3B are a top and bottom view, respectively, of the strap adjuster and keeper of FIG. 2.
Figure 3B:
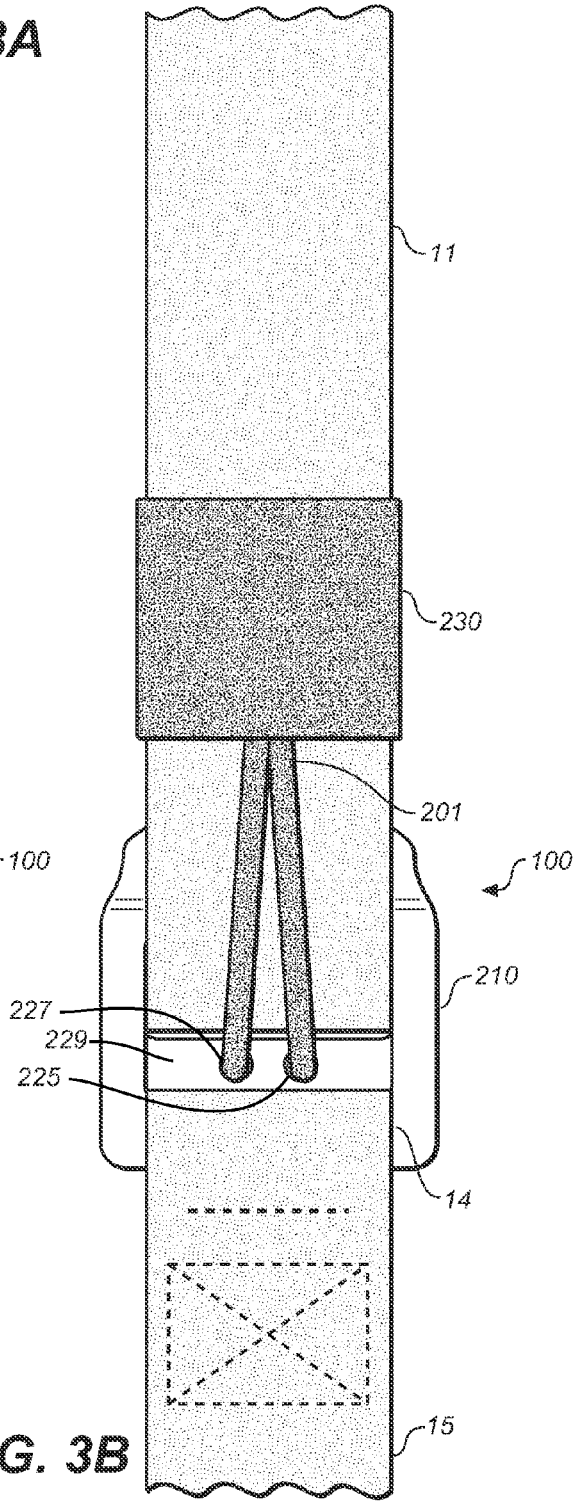
Figure 4A:
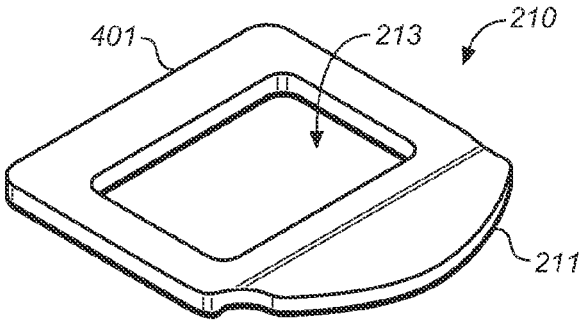
FIGS. 4A, 4B, and 4C are perspective, top, and side views, respectively, of the first element of a strap-length adjuster.
Figure 4B:
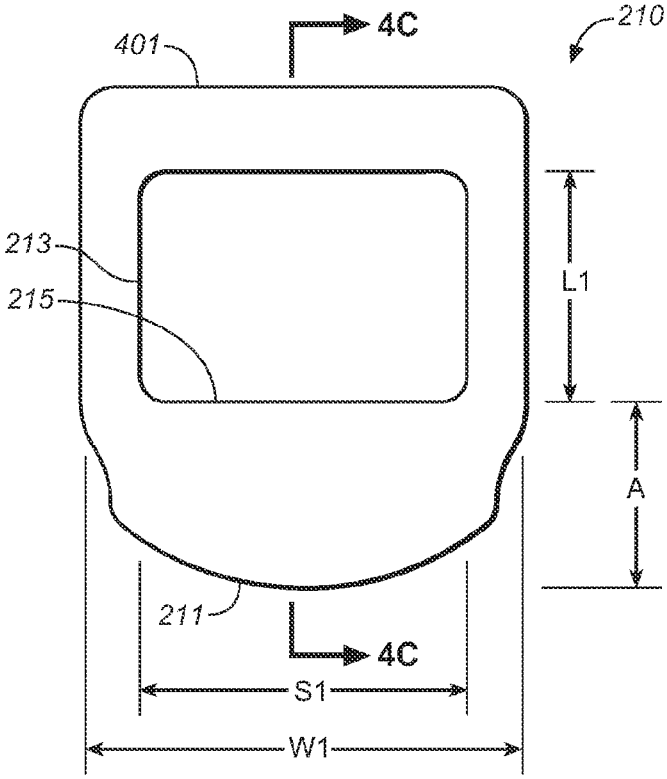
Figure 4C:
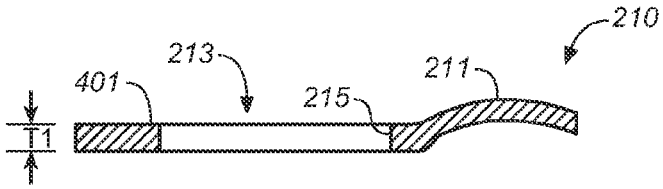
Figure 5A:
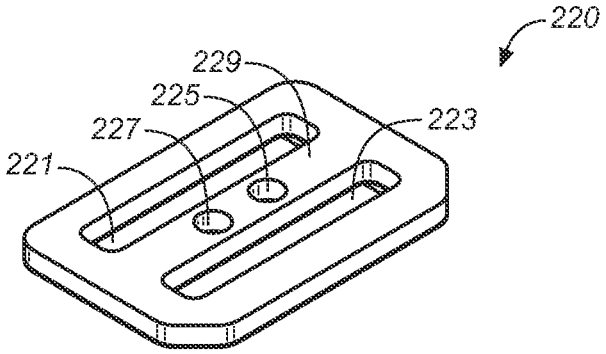
FIGS. 5A, 5B, and 5C are perspective, top, and side views, respectively, of the second element of a strap-length adjuster.
Figure 5B:
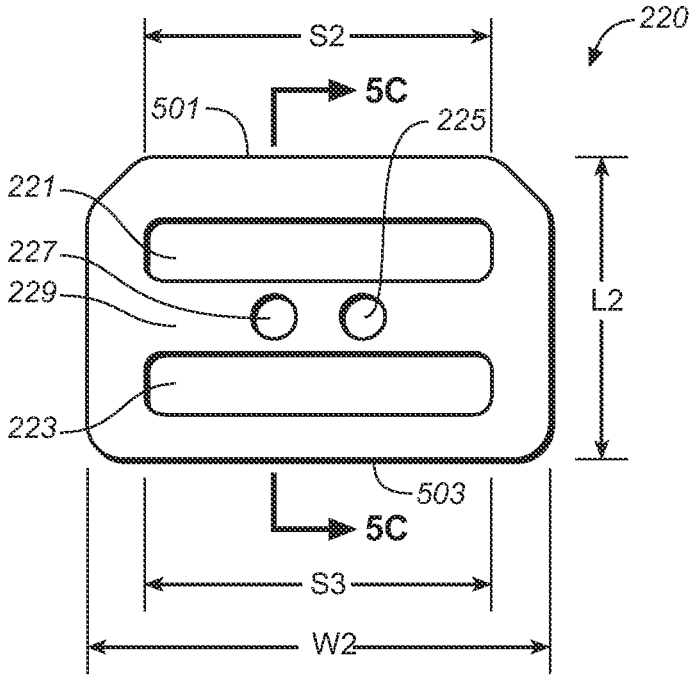
Figure 5C:
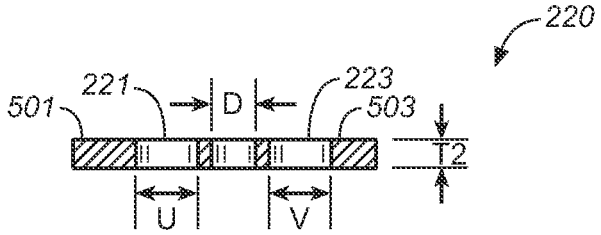
Figure 6A:
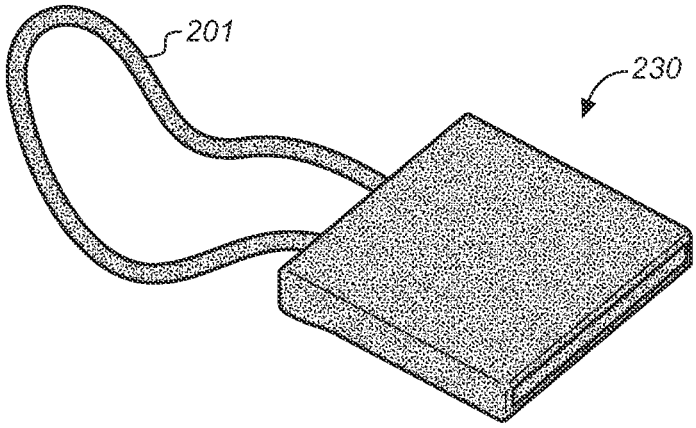
FIGS. 6A, 6B, and 6C are perspective, top, and side views, respectively, of a strap keeper and tether.
Figure 6B:
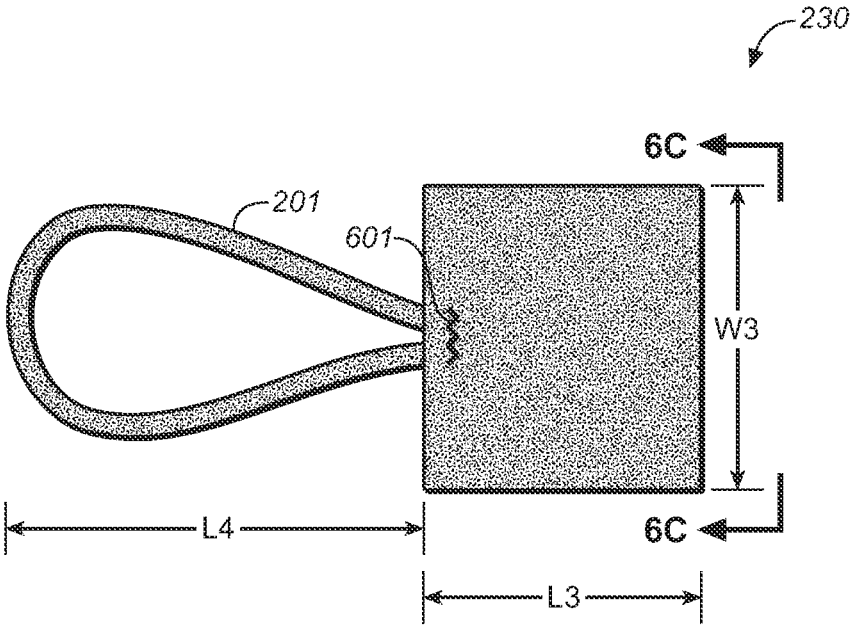
Figure 6C:
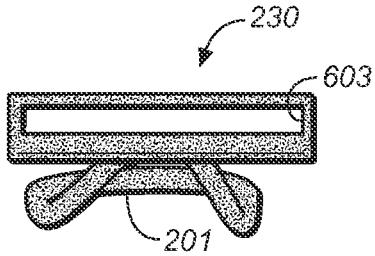

One embodiment of strap adjuster and keeper 100, which is generally similar to first strap adjuster and keeper 100*a* or second strap adjuster and keeper 100*b*, is shown in FIGS. 2-6, where FIG. 2 is a detailed perspective view of another embodiment of the strap adjuster and keeper, FIGS. 3A and 3B are a top and bottom view, respectively, of the strap adjuster and keeper, FIGS. 4A, 4B, and 4C are perspective, top, and side views, respectively, of the first element of a strap-length adjuster, FIGS. 5A, 5B, and 5C are perspective, top, and side views, respectively, of the second element of a strap-length adjuster, and FIGS. 6A, 6B, and 6C are perspective, top, and side views, respectively, of a strap keeper and tether.

As shown in FIGS. 2, 3A, and 3B, strap adjuster and keeper 100 includes a strap-length adjuster 200, a strap keeper 230, and a tether 201 that connects the strap-length adjuster 200 to the strap keeper 230.

Strap-length adjuster 200 includes a first ring 210 and a second ring 220, both of which may be generally flat and rectangular rings, and have one or more openings. First ring 210, which is shown in greater detail is FIGS. 4A, 4B, and 4C, has an opening 213 with a tab 211 and a surface 215 at one end, and a bar 401 at an opposing end, First ring 210 has a thickness T1 and a width and opening 213 has a width S1 that is sized to accept the width of strap 11 and a length L1, and tab 211 protrudes a distance A from the opening.

Second ring 220, which is shown in greater detail in FIGS. 5A, 5B, and 5C, has a first opening 221 and a second opening 223 separated by a crossbar 229. Specifically, first opening 221 is bounded on one side by a first bar 501 and on the opposite side by crossbar 229, and second opening 223 is bounded on one side by the crossbar and on the opposite side by a second bar 503. Crossbar 229 has a first hole 225 and second hole 227 forming passageways through second ring 220. Second ring 220 has a thickness T2, length L2, and width W2. First opening 221 has a width S2 and length U sized to accept loop 12, and second opening 223 has a width S3 and length V sized to accept the width of strap 13. Holes 225 and 227 each have a diameter D sized to accept tether 201.

Strap keeper 230, which is shown in greater detail is FIGS. 6A, 6B, and 6C has an opening 603 sized to accept two layers of strap 13, Strap keeper 230 has a width W3 sized to accept the width of strap 13, and a length L3. Tether 201 is a loop of material of length 2×L4 that is attached to strap keeper, for example by stitches 601 to the inside surface of opening 603.

In general first ring 210 and second ring 220 are formed from a rigid material, such as metal, plastic, aluminum or steel, In one embodiment, straps 11 and 13 both have a width of 38 mm and a thickness of 2 mm, and rings 210 and 220 are sized, for example and without limitation, with T1=3 mm, W1=53 mm, S1=39 mm, A=22 mm, T2=3 mm L1=27 mm, L2=34 mm, W2=52 mm, S2=39 mm, U=7 mm, S3=39 mm, V=7 mm and D=5 mm. In other embodiments, straps 11 and 13 may have the same or different sizes, ranging from 6 mm to 75 mm, and the size of rings 210 and 220 may be sized appropriately.

Strap keeper 230 is formed from elastic or inelastic webbing. For the example of 11 and 13 both have a width of 38 mm and a thickness of 2 mm, W3 may be 38 mm and L3 may be 38 mm.

Tether 201 may be formed from elastic or inelastic cord or line. The length L4 may be, for example and without limitation, from 25 mm to 100 mm, The length L4 may this be 25 mm, 50 mm, 75 mm, or 100 mm.

In an alternative embodiment, tether 201 passes through one hole in crossbar 229, and is knotted to secure the tether to second ring 220.

Figure 7A:
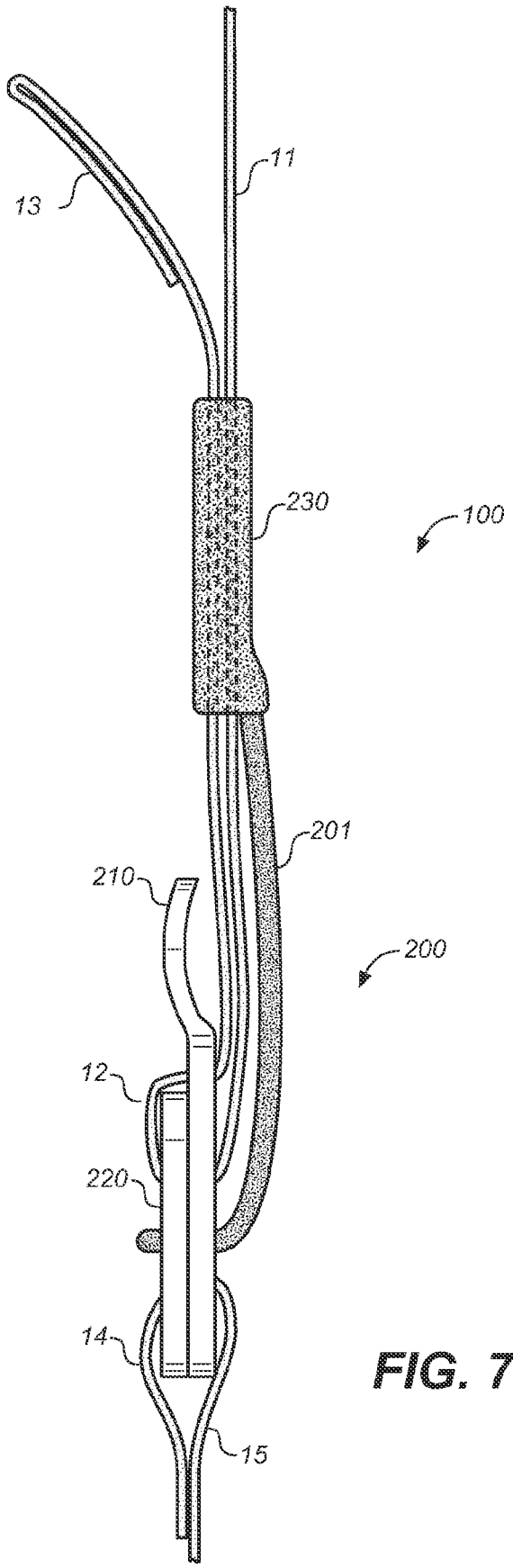
FIG. 7A is a side view of the strap adjuster and keeper in a "locked" configuration.

FIG. 7A is a side view of strap adjuster and keeper 200 in a "locked" configuration. Loop 14 is secured over bar 401 through opening 213, and over bar 503 through opening 223. Loop 12 is formed by passing end 13 first through opening 213, then through opening 221, over bar 501, and back through opening 213, as is also shown in FIGS. 2, 3A, and 3B, Loop 12 is thus provided with frictional forces from first ring 210 on surface 215 and second ring 220 to prevent slippage of strap 11. In addition, tether 201 retains the movement of strap keeper 230 to be near strap-length adjuster 200, thus keeping the portions of strap 11 near each other.

Figure 7B:
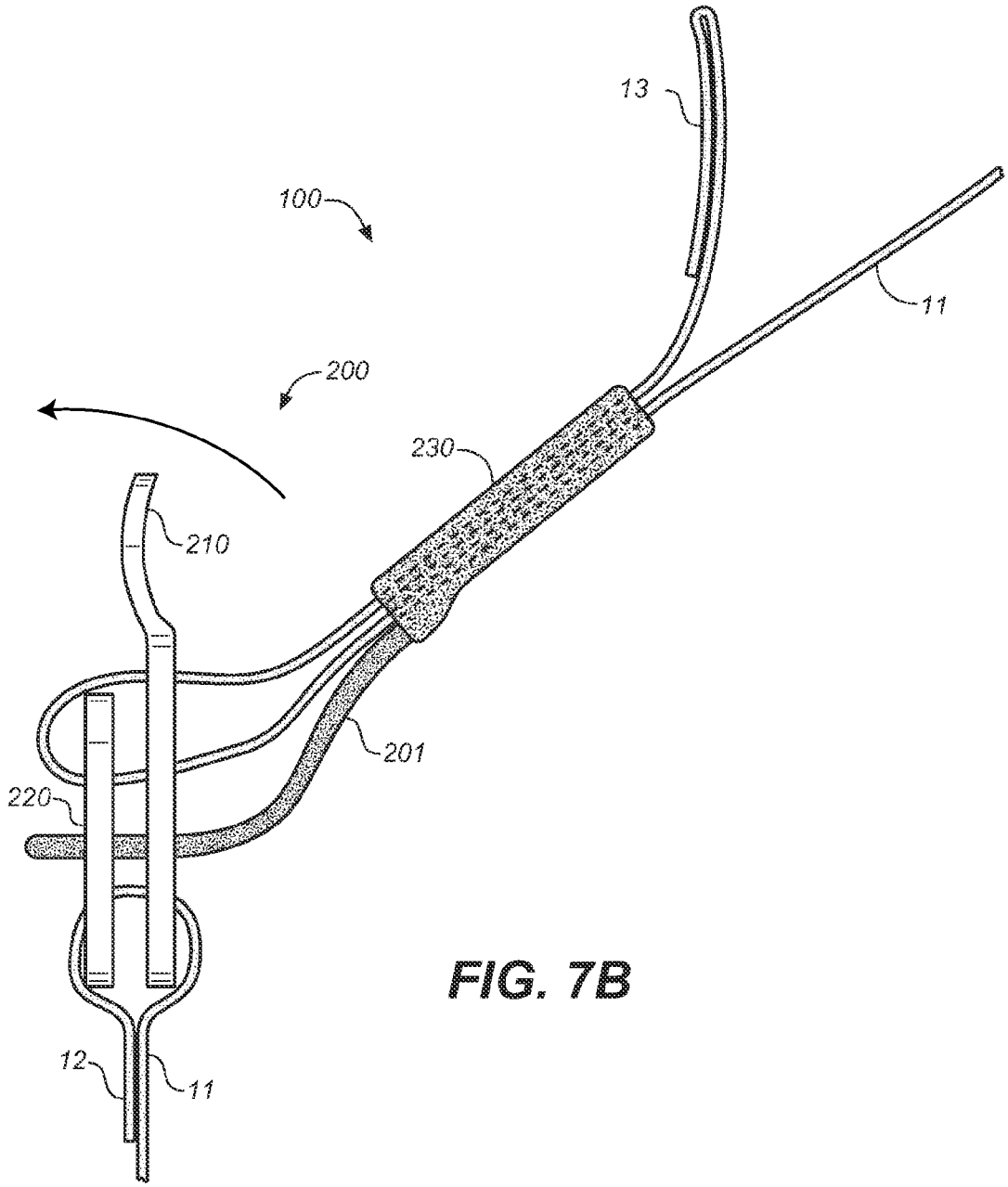
FIG. 7B is a side view of the strap adjuster and keeper configured for adjusting the length of the strap.

FIG. 7B is a side view of strap adjuster and keeper 200 configured for adjusting the length of strap 11, When tab 211 is moved way from strap 11, the hold of first ring 210 and second ring 220 on strap is loosened, permitting the movement of strap 11 through strap keeper 230 to either lengthen or shorten strap 11. Tether 201 continues to retain the movement of strap keeper 230 to be near strap-length adjuster 200. It is apparent from FIGS. 7A and 7B that tether 201 limits the strap-length adjuster 200 to strap keeper 230 distance, while not interfering with the movement of strap 11, when required.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

We claim:

1. An apparatus for attaching to a closed loop of a first strap and for providing a gripping force to a second strap having a free end, said apparatus comprising:

a strap keeper to accept the second strap;

a strap-length adjuster including a first element having a first opening and a second element having a second opening each sized for jointly accepting the closed loop, where said second element includes a third opening and a crossbar disposed between said second opening and said third opening, wherein said first element includes a tab and said crossbar includes at least one passageway; and a tether attached to said strap keeper, where said tether is attached to said crossbar using said at least one passageway, such that the free end can be wrapped through said first opening and said third opening to adjust the position of said second strap in said strap-length adjuster, such that the strap keeper can accept said second strap and the free end of said second strap, and such that the movement of said strap keeper is limited by said tether and said tab is adapted to be moved away from said second strap to permit the movement of said second strap through said first opening and said third opening.

2. The apparatus of claim 1, where said tether passes through said at least one passageway.

3. The apparatus of claim 2, where said at least one passageway is two or more passageways, and where said tether passes through at least two of said passageways.

4. The apparatus of claim 1, where said tether passes through said first opening.

5. The apparatus of claim 1, where said tether limits the movement of the strap keeper to within 25 mm of the strap-length adjuster.

6. The apparatus of claim 1, where said tether limits the movement of the strap keeper to within 50 mm of the strap-length adjuster.

7. The apparatus of claim 1, where said tether limits the movement of the strap keeper to within 75 mm of the strap-length adjuster.

8. The apparatus of claim 1, where said tether limits the movement of the strap keeper to within 100 mm of the strap-length adjuster.

9. The apparatus of claim 1, where said tether is formed from an elastic cord.

10. The apparatus of claim 1, where said tether is formed from an inelastic cord.

11. The apparatus of claim 1 further comprising an exercise device attached to said apparatus, the exercise device comprising:

an inelastic strap;

a pair of grips attached to said inelastic strap; and wherein said apparatus is attached to said inelastic strap, such that the length of said inelastic strap between said grips is adjustable.

12. A method of strap control, comprising the steps of:

using a strap keeper for a strap-length adjuster attachable to a closed loop of a first strap and adapted to accept a free end of a second strap, said strap-length adjuster including a first element having a tab and a first opening and a second element having a second opening, each of said first opening and said second opening sized for jointly accepting the closed loop, where said second element includes a third opening and a crossbar disposed between said second opening and said third opening, such that the free end is adapted to be wrapped through said first opening and said third opening to adjust the position of said second strap in said strap-length adjuster, such that the strap keeper accepts said second strap and the free end of said second strap, said method further comprising:

attaching a tether to said strap keeper and to said crossbar, such that the movement of said strap keeper is limited by said tether; and moving said tab away from said second strap to permit the movement of said second strap through said first opening and said third opening;

wherein said crossbar includes one or more passageways, and wherein said step of attaching said tether includes passing said tether through said one or more passageways.

13. The method of claim 12, where said attaching further includes passing through said first opening.

14. The method of claim 12, where said tether limits the movement of the strap keeper to within 25 mm of the strap-length adjuster.

15. The method of claim 12, where said tether limits the movement of the strap keeper to within 50 mm of the strap-length adjuster.

16. The method of claim 12, where said tether limits the movement of the strap keeper to within 75 mm of the strap-length adjuster.

17. The method of claim 12, where said tether limits the movement of the strap keeper to within 100 mm of the strap-length adjuster.

18. The method of claim 12, where said tether is formed from an elastic cord.

19. The method of claim 12, where said tether is formed from an inelastic cord.

* * * * *